United States Patent [19]

Bailey

[11] Patent Number: 4,493,443

[45] Date of Patent: Jan. 15, 1985

[54] MULTIPOSITION VALVED DISPENSER

[76] Inventor: Ralph J. Bailey, 64 Derbyshire St., Derby, Conn. 06418

[21] Appl. No.: 508,045

[22] Filed: Jun. 27, 1983

[51] Int. Cl.[3] ..... B67D 5/42

[52] U.S. Cl. ..... 222/400.8; 251/291; 222/529

[58] Field of Search ..... 137/212; 251/240, 241, 251/245, 246, 291; 222/400.7, 400.8, 401, 402, 530, 640, 641; 116/114 R, 115

[56] References Cited

U.S. PATENT DOCUMENTS

| | | | |
|---|---|---|---|
| 2,097,063 | 10/1937 | Heller . | |
| 2,143,655 | 1/1939 | Heller . | |
| 4,350,270 | 9/1982 | Nezworski . | |
| 4,392,594 | 7/1983 | Swett et al. | 222/530 |

*Primary Examiner*—Stanley H. Tollberg
*Attorney, Agent, or Firm*—Robert A. Seemann

[57] ABSTRACT

A valved dispenser for use with a pump and tap assembly, for dispensing kegged beer and other beverages alternatively in the manner of a fountain dispenser or in the manner of a hand held dispenser, includes a first handle and portion of a cam actuating arrangement suited to hand held operation, and a second handle used in conjunction with the first handle and another portion of the cam actuating arrangement as well as retaining coupler elements on the pump and tap assembly and valve for effectively converting the dispenser to the fountain type. To reduce foam generation while dispensing, a stem guide is formed to permit fluid passing through the valve to flow around the guide for reduced flow velocity. A threaded valve seat element and push-back stem with ready access to a key pivot pin are included for simplified valve disassembly for cleaning and maintenance. In a preferred embodiment one coupler element comprises the bearing housing portion of the pump which is uniquely suited for such incorporation as part of new pump manufacture as well as for such conversion of existing pump and tap assembly pumps for use in the present invention.

16 Claims, 7 Drawing Figures

FIG. 3
FIG. 2
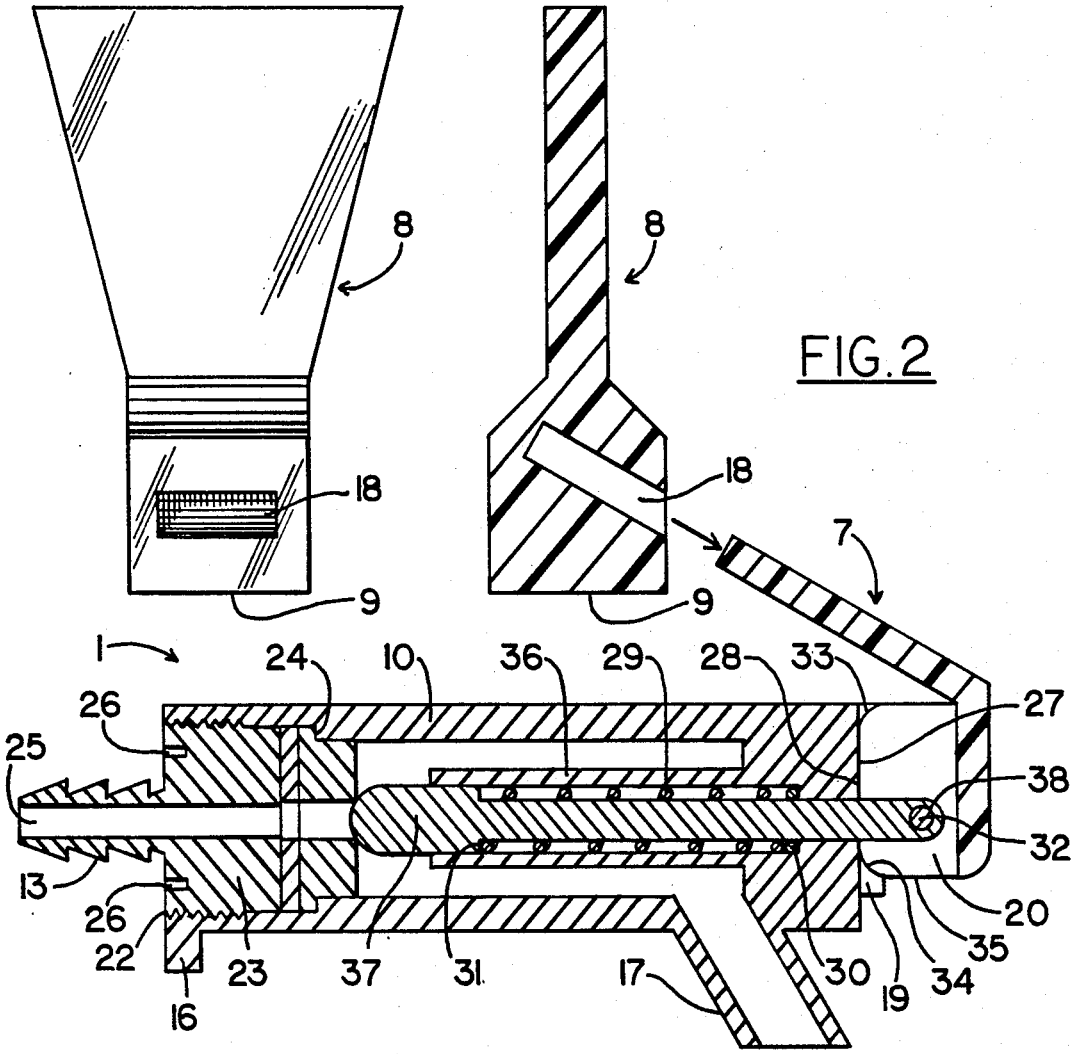
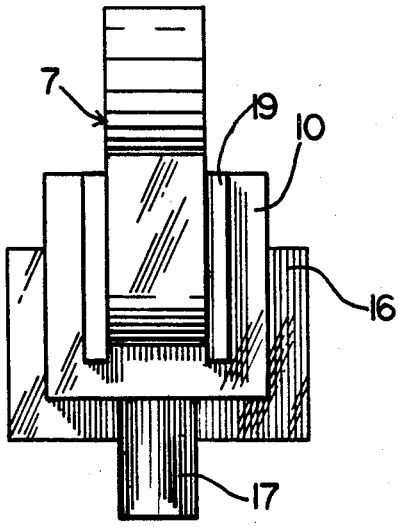
FIG. 4

MULTIPOSITION VALVED DISPENSER

BACKGROUND OF THE INVENTION

1. Field of the Invention

The present invention relates to dispensers and more particularly to a multiposition valved dispenser for beer and other liquids to be delivered from a portable keg, for use in conjunction with the hand pump and tap assembly typically employed to pressurize the keg.

2. Description of the Prior Art

There are basically two kinds of valved dispensers for beer and the like. The first, fountain or fixed type delivers the fluid in a downward manner from its fixed position on a stanchion type support. It is preferably operated by moving a top mounted, upwardly extending handle toward the operator for fluid flow and away for shut off. Often the handle is designed with spring return, the handle coming to rest at the off position. A valved dispenser of the type, for example, is described in U.S. Pat. Nos. 2,097,063 of Oct. 26, 1937 and 2,143,655 of Jan. 10, 1939 issued to K. Heller.

The second kind of valved dispenser is hand held and therewith positioned for downward fluid delivery. It is attached to the end of a flexible tube and is preferably operated for fluid flow by squeezing a handle to the valve body, against a spring return force toward its off, rest position. One embodiment of the hand held dispenser is illustrated in conjunction with a keg tap with pump in U.S. Pat. No. 4,350,270 of Sept. 21, 1982 issued to James E. Nezworski.

When used for beverage delivery in conjunction with a keg source, each kind of dispenser possesses its own unique advantages. Although containers must be brought to the fixed fountain type dispenser for filling, its operation requires only a momentary pull of the handle during filling, leaving the operator's hands free to handle the containers. It is most practical for economical self service by many operators, and less messy for use by them because the direction of flow is predictable, enabling precautions to be taken for reliable collection overflow. This is especially convenient when the keg dispensing is away from a plumbing drain.

The hand held valved dispenser, on the other hand is more convenient for use by a single operator when filling containers held at various locations around the keg. It requires more care in handling to avoid spill and contamination of the nozzle and is typically used for controlled service conditions.

Presently, pump and tap assemblies have either a valved fountain type dispenser as an integral part of the assembly's pump or a hand held valved dispenser located at the end of a flexible hose which is connected to the pump body. A user must therefore accept the advantages and disadvantages of the particular dispenser provided.

Regardless of the dispenser type used, operation by inexperienced and multiple operators often results in mess and waste from foam generated in the glass as the fluid is dispensed, due to dispenser high velocity flow characteristics.

In present keg beer sales commerce, the dispenser pump and tap apparatus is rented or sold by the keg beer seller as a necessary accessory for the keg. The dispensers are not very easy and fast to clean and repair. Furthermore, stocking of both types to afford the customer a choice, raises costs for the seller and ultimately for the user.

SUMMARY OF THE INVENTION

It is one object of the invention to provide a valved dispenser for use with pump and tap assembly which affords the advantages, and eliminates the disadvantages of both the fountain and the hand held type dispensers.

It is another object of the invention to lower inventory cost for the keg beverage seller and ultimately for the consumer by providing in a single, valved dispenser, both fixed fountain and hand held fluid delivery service.

It is another object of the invention to provide a multiposition valved dispenser having a valve which permits dispensing beer and other carbonated beverages with minimal head formation.

It is yet another object of the invention to provide a multiposition valved dispenser having a rapid take-down, easy to clean valve.

In accordance with the present invention there is provided a valved dispenser for use with a pump and tap assembly for dispensing kegged beer and other beverages, alternatively in the manner of a fountain dispenser or in the manner of a hand held dispenser as described, and which may deliver the beverage with minimum foam generation. The dispenser includes a first handle and actuating arrangement most suited to hand held operation; and a second handle used in conjunction with the first handle as well as means for detachably mounting the dispenser on the pump and tap assembly for effectively converting the dispenser to the fountain type, for operation specifically suited to this type as described earlier.

In one embodiment there is included a valve providing foam reducing internal flow characteristics including a stem guide formed to permit fluid passing through the valve to flow around the guide during its passage on out through the dispenser's spigot.

A threaded valve seat element and push-back stem with ready access to a key pivot pin permit quick and easy valve maintenance.

In another embodiment the means for detachably mounting the dispenser on the pump and tap assembly comprises a portion of the pump that is uniquely suited for incorporating the mounting means as part of new pump manufacture or for inexpensive conversion of existing pump and tap assembly pumps for use in the present invention.

BRIEF DESCRIPTION OF THE DRAWINGS

In order that the invention may be more fully comprehended it will now be described, by way of example, with reference to the accompanying drawings, in which:

FIG. 2 is a left side sectional view showing various features of the valve portion of the invention and a second handle.

FIG. 3 is a front view of a second handle of the invention.

FIG. 4 is a front view of the valve with first handle and means for preventing its lateral rotation according to one embodiment of the invention.

DESCRIPTION OF THE PREFERRED EMBODIMENTS

Figure 1:
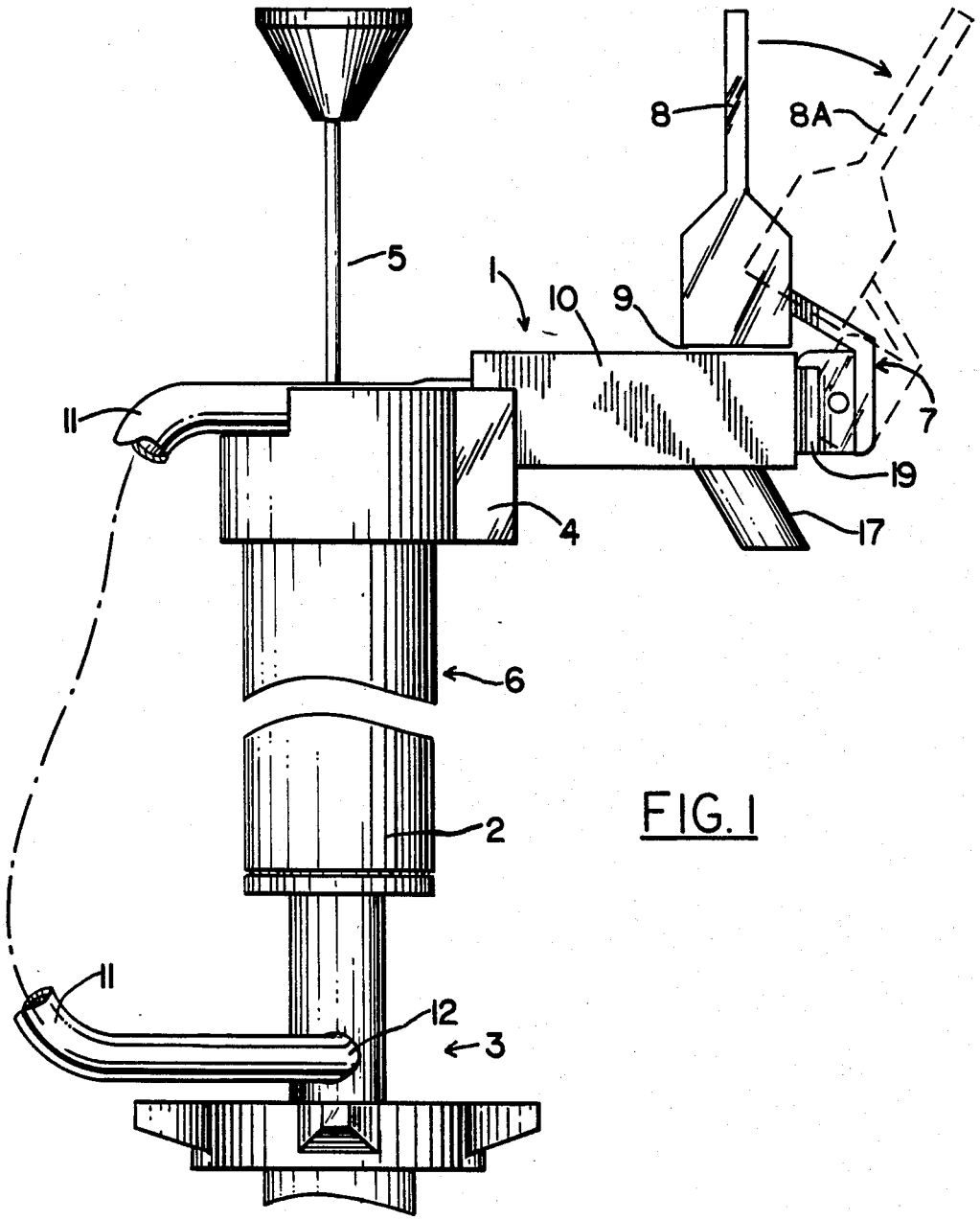
FIG. 1 is a left side perspective view showing the valve, pump and tap assembly mated in the tavern dispenser configuration according to one embodiment of the invention.
Figure 5:
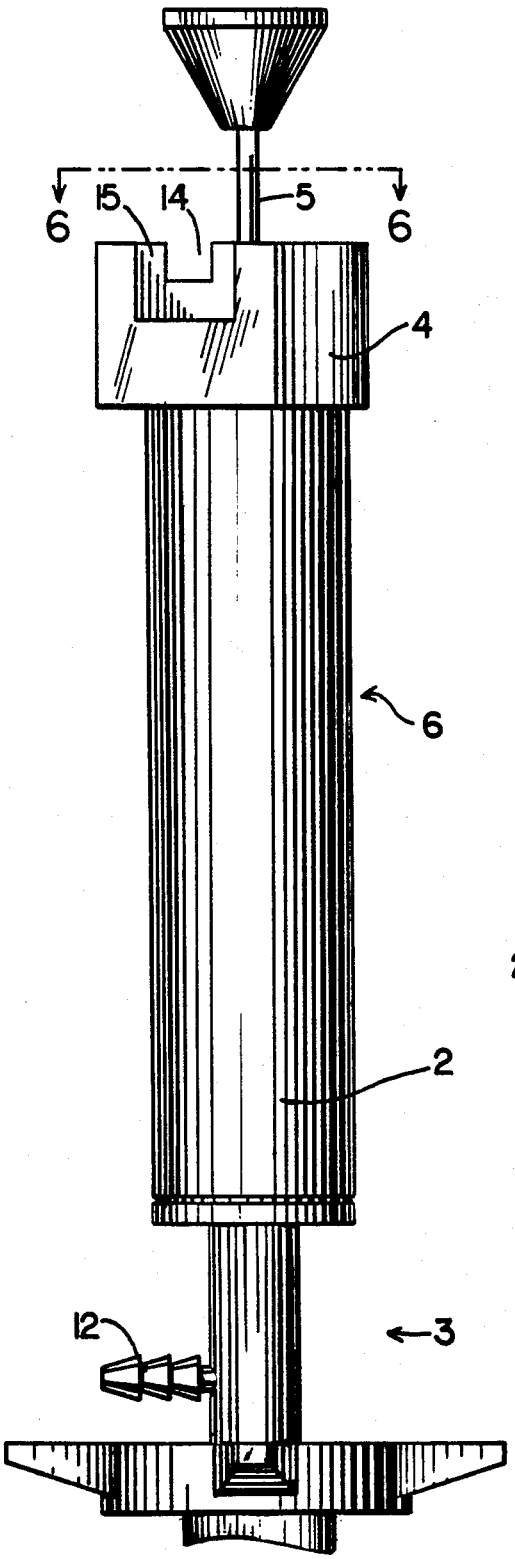
FIG. 5 is a front prespective view of a means for mounting the valve on the pump portion of the pump and tap assembly, the means comprising a portion of the pump according to the invention.
Figure 6:
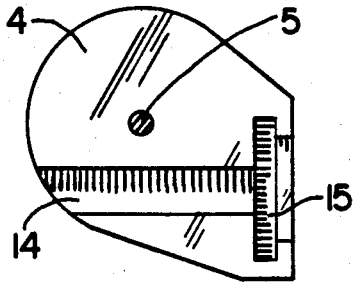
FIG. 6 is a sectional view taken at AA of a mounting means of FIG. 5.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to the drawings wherein like components are designated by like reference, throughout the various figures, in FIG. 1 there is shown a preferred embodiment of the invention in which valve 1 is preferably mated with pump 2 of the pump and tap 3 assembly for operation as a fountain type dispenser. The valve is retained on the pump by a male and female member retaining couple 16, 15 (not visible), with the female element 15 located in the pump bearing housing 4 portion of the pump. The bearing housing 4 retains pump shaft 5 bearing and is mounted on pump housing 6 as is common in hand pump manufacture. The pump bearing itself is not shown as it would only serve to clutter the illustration of the invention. What should be noted here, however is that the bearing housing is usually manufactured as part of a replaceable end cap assembly for the pump housing. Thus while for new manufacture of the invention the bearing housing having the retaining couple element would be provided as part of the pump housing, the bearing housing of the instant invention may also be advantageously designed so that it will readily replace end caps on existing pumps to convert those pump and tap assemblies for use in the instant invention.

Returning to the valve of FIG. 1, in order to dispense fluid, second handle 8 which is mounted on first handle 7 is rotated toward position 8A in the manner of a tavern fountain type dispenser. Second handle 8 is shown in FIG. 3 as a flattened member but it is to be understood that it may include a ball on the end or some other convenient shape. The second handle is mounted on the first handle by way of slot 18 which closely fits first handle 7.

The base of second handle 8 includes a bearing surface 9 which contacts the valve housing 10 when the handle is in the off position. This bearing surface also prevents the valve from spurting, for reason explained later, when the handle is flipped to the off position.

Tavern handles generally have rotation restricted to one plane. Mounted as it is on the first handle, the second handle moves in the same plane as the first handle which is indirectly restricted to one plane of rotation by rib 19 that is part of the top of valve housing 10. Rib 19 provides this restriction by its intimate sliding contact with cam 20 to which handle 7 is attached.

The valve receives fluid for dispensing via flexible tube 11 which receives the keg fluid from coupler 12 on the pump and tap assembly and delivers it to the valve through coupler 13 located at the back of the valve. Coupler 13, which is recessed in the bearing housing within groove 14, is out of sight in FIG. 1. Forward of groove 14 is the female element 15 of the pump and valve retaining couple for detachably mounting the valve housing on the pump and tap assembly. The female element comprises a three-sided slot for accepting and holding the valve's three-sided male element 16. As can be clearly seen, the male and female retaining couple when engaged, position and retain the valve for dispensing downward when the pump and tap assembly is positioned with the pump stem vertical and at the top, which is typical for installation of the tap in a keg.

It will be understood that the retaining couple for detachably mounting the valve on the pump and tap assembly is not limited to the male and female arrangement and elements shown. It may comprise for example an indexed or splined shaft and socket or some other valve-position retaining couple augmented with magnets. It may be attached elsewhere on the pump housing or on some other convenient part of the pump and tap assembly.

Figure 7:
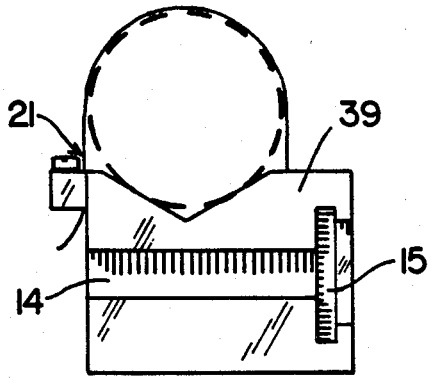
FIG. 7 is a top view of another mounting means according to the invention.

Older pump and tap assemblies may be converted for use in the invention by affixing an element 39 comprising one of the retaining couple members as shown in FIG. 7, to the pump and tap assembly, by adjustable threaded clamp 21 or glue or other means for joining.

And now to the valve. Housing 10 of valve 1 includes threads 22 and recessed annular shoulder stop 24 for receiving threaded valve seat element 23 with mating shoulder, to a predetermined depth within the valve housing. The valve seat element includes coupler 13 with thru passage 25 running through the valve seat through which fluid may enter the valve housing. Two torque-receiving bearing surfaces for installing and removing threaded element 23 are provided by pin receiving sockets 26 located equidistant from the element's center line. Alternative bearing surfaces may include hex surfaces at the rear of coupler 13 or, less preferable, a single off center rib to provide one bearing surface, the other being a fulcrum on coupler 13. Valve seat 23 mates sealingly with the nose portion of stem 37 effectively blocking liquid flow through the valve and out spigot 17 when the valve is in the off state. It is then that cam 20 bearing surface 27 is resting against bearing surface 28 on valve housing 10. Spring 29, by simultaneously bearing against the valve housing by way of sealing ring 30 and against stem shoulder stop 31, urges the stem head to the valve seat and draws cam 20 to valve housing bearing surface 28, by way of the linkage comprising the stem and cam pivot 32. First handle 7 is attached to the cam so that displacement of the handle towards the valve body engages a new cam bearing surface 33 that is further from pivotal axis 32 than is surface 27, thus drawing the stem back out of the housing and opening the valve seat for fluid flow into and through the valve.

Rounded cam bearing surface 33 engages the valve housing bearing surface at a location which is outside the line of travel of the cam's pivot and, providing an unstable equilibrium, allows spring 29 to close the valve, cam bearing surface 27 engaging, when the first handle is released. Thus, when in hand held configuration, the valve is operated most practically by one-handed momentary squeezing action and will not remain on when released.

Second handle 8 is mounted on first handle 7 when the valve is in the fountain dispenser mode as explained earlier. Rotating handle 8 toward position 8A brings rounded cam bearing surface 34 to bear on the housing bearing surface at an area just within or sufficiently close to the cam pivot line of travel so that rounded portion 34 and adjacent flat surface 35 serve as stable valve-on cam bearing surfaces. Valve operation, therefore is similar to that of a tavern fountain with variable on positions for the handle and a bit of snap to the off position. Given sufficient mass, handle 8 would pass right on through the stable off position on the snap-back if it were not for the limit stop afforded by handle bearing surface 9 as explained earlier.

The stable-on position can also be attained with the valve in hand held configuration but by an awkward two-handed manipulation and hardly by unconscious accident.

The stem is held in alignment and slidably guided during its travel towards the valve seat by stem guide 36 which maintains slidable contact in the area between the stem head and shoulder stop 31. The guide also serves to retain spring 29 located on the stem, resisting any tendency of the spring to bunch out of concentric alignment.

Between stem guide 36 and valve housing 10 there is formed a flow path, for liquid passing through the valve, which permits liquid to well out of the valve seat into a flow path comprising a larger cross sectional area making possible a reduced and smoother rate of flow for dispensing with minimal head formation. Stem guide 36 may be formed as a collar for minimum turbulance in the surrounding flow path.

The dispenser with pump and tap, being often rented, a capability for quick dissassembly for maintenance and cleaning by the keg beverage seller is preferred. Quick and easy take down of the valve is accomplished by engaging pin receiving sockets 26 and screwing out valve seat element 23. A plastic rod is then inserted into the valve housing and pressed against the stem head to push the stem back, against spring 29 resistance, lifting the cam from the bearing surface and extending the cam pivot linkage portion of the stem beyond the top of rib 19 to clear the way for removal of pivot pin 38. The plastic rod is then removed releasing the stem, spring and sealing ring for easy removal and cleaning.

From the foregoing description of the invention it is seen that the Multiposition Valved Dispenser for Use With Pump and Tap Assembly provides advantages of fountain and hand-held type dispensers and contributes to dispensing of beer and other carbonated beverages with minimal head formation. It reduces inventory costs for the keg beer seller and includes a valve which permits quick and easy maintenance. It may be incorporated with the pump and tap assembly as original equipment and may also be combined in retrofit with an existing pump and tap assembly with only slight modification of the assembly.

Although the present invention has been described with respect to details of cartain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A multiposition valved dispenser for use with a pump and tap assembly of the type used for kegs, comprising:

on said pump and tap assembly, means for coupling and a flexible tube connected to said means for delivery of the keg fluid by way of said tube, and further comprising;

a valve having means for effecting on states and an off state with respect to fluid flow, said valve including, a housing, a spigot mounted on the housing for delivery of the fluid by said dispenser and means for coupling said flexible tube to the housing for delivery of the fluid to the valve;

a first handle member rotably mounted on the valve for controlling the valve's on states by angular displacement of said handle away from a pre-determined off position with respect to the valve housing, a second handle member detachably mounted on the first handle for moving same, and angled from said first handle so that said second handle establishes a new off position with respect to the valve housing, and means for detachably mounting said valve housing on said pump and tap assembly.

2. The invention as set forth in claim 1 wherein:

said means for effecting the valve states includes;

a cam having a pivotal axis and a substantially flat bearing surface, a bearing area on the valve housing and means for biasing the cam against said bearing area, and an actuating linkage connected to said pivotal axis, which moves with the axis, for controlling the valve states;

said first handle member is attached to the cam for rotation of the cam by angular displacement of the handle for controlling the valve's on states, said off state position is established upon bearing of said flat cam surface against the bearing area on the valve housing.

3. The invention as set forth in claim 1 or 2 wherein:

said means for detachably mounting said valve housing on said pump and tap assembly includes a retaining couple which comprises;

a male member and a female member, one mounted on the valve housing and the other mounted on the pump and tap assembly, each positioned so that when engaged they position the valve so that the spigot dispenses downward when the keg is used as a stationary fluid supply source.

4. The invention as set forth in claim 3 wherein:

the pump portion of the pump and tap assembly includes;

a pump housing, a pump shaft, a bearing for holding the shaft in proper alignment and a bearing housing for retaining the shaft bearing, said bearing housing is mounted on the pump housing and includes a retaining couple member.

5. The invention as set forth in claim 1 or 2 wherein said valve housing includes: an extending portion in intimate sliding contact with the cam for restricting the handle members' angular displacement to that of movement in a predetermined plane with respect to the housing.

6. The invention as set forth in claim 3 wherein said valve housing includes: an extending portion in intimate sliding contact with the cam for restricting the handle members' angular displacement to that of movement in a predetermined plane with respect to the housing.

7. The invention as set forth in claim 1 or 2 wherein: said second handle member includes a bearing surface for restricting the handle's angular displacement within an arc from and to but not through the pre-determined off position, said bearing surface is so located on said second handle so that it contacts the valve housing when the handle is in the off position.

8. The invention as set forth in claim 3 wherein: said second handle member includes a bearing surface for restricting the handle's angular displacement within an arc from and to but not through the pre-determined off position, said bearing surface is so located on said second handle so that it contacts the valve housing when the handle is in the off position.

9. The invention as set forth in claim 2 wherein said valve further comprises:

a valve seat element located in said housing through which fluid may enter the valve housing, a valve stem having a head which may sealingly mate with the seat to prevent fluid flow into the valve housing, a portion of the stem passes through the valve housing for engaging with said actuating linkage, means for sealing to prevent leakage around the shaft, situated within the valve housing in close communication with the housing and in sliding communication with the shaft, a stem guide extending internally from the housing, said guide having bearing points in slidable contact with the stem near the head for holding the stem in alignment with the seat, said stem including a stop behind the head for receiving urging force, resilient means disposed between the stem guide and the stem for exerting forces simultaneously against the stem stop and the housing for urging the stem head toward the valve seat and, by way of the actuating linkage, drawing and biasing the cam against the valve housing bearing area, said stem guide extending internally from the housing is formed to permit fluid passing through the valve to flow around the guide during its passage on out through the spigot.

10. The invention as set forth in claim 9 wherein:

said means for detachably mounting said valve housing on said pump and tap assembly includes a retaining couple which comprises;

a male member and a female member, one mounted on the valve housing and the other mounted on the pump and tap assembly, each positioned so that when engaged they position the valve so that the spigot dispenses downward when the keg is used as a stationary fluid supply source.

11. The invention as set forth in claim 10 wherein said valve housing includes:

an extending portion in intimate sliding contact with the cam for restricting the handle members' angular displacement to that of movement in a predetermined plane with respect to the housing, and said second handle member includes a bearing surface for restricting the handle's angular displacement within an arc from and to but not through the pre-determined off position, said bearing surface is so located on said second handle so that it contacts the valve housing when the handle is in the off position.

12. The invention as set forth in claim 11 wherein:

the pump portion of the pump and tap assembly includes;

a pump housing, a pump shaft, a bearing for holding the shaft in proper alignment and a bearing housing for retaining the shaft bearing, said bearing housing is mounted on the pump housing and includes a retaining couple member.

13. The invention as set forth in claim 11 wherein:

said valve seat element includes a threaded portion, and means for coupling said flexible tube for delivery of fluid to the valve, said valve housing includes threads and a stop for securing the valve seat in the housing to a predetermined depth when the valve seat element is screwed into the housing.

14. The invention as set forth in claim 12 wherein:

said valve seat element includes a threaded portion, and means for coupling said flexible tube for delivery of fluid to the valve, said valve housing includes threads and a stop for securing the valve seat in the housing to a predetermined depth when the valve seat element is screwed into the housing.

15. The invention as set forth in claim 14 wherein: said valve seat element includes at least two bearing surfaces for receiving torquing forces for installing and removing said element.

16. A valve having means for effecting on states and an off state with respect to fluid flow, said valve comprising:

a housing, a spigot mounted on the housing, means for coupling a tube to the housing for delivery of fluid to the valve, a handle member rotably mounted on the valve for controlling the valve's on states by angular displacement of said handle away from a predetermined off position with respect to the valve housing, said means for effecting the valve states includes;

a cam having a pivotal axis and a substantially flat bearing surface, a bearing area on the valve housing and means for biasing the cam against said bearing area, and an actuating linkage which is connected to said pivotal axis, which moves with the axis, for controlling the valve states;

said handle member is attached to the cam for rotation of the cam by angular displacement of the handle for controlling the valve's on states, said off state position is established upon bearing of said flat cam surface against the bearing area on the valve housing, a valve seat element located in said housing through which fluid may enter the valve housing, a valve stem having a head which may sealingly mate with the seat to prevent fluid flow into the valve housing, a portion of the stem passes through the valve housing for engaging with said actuating linkage, means for sealing to prevent leakage around the shaft, situated within the valve housing in close communication with the housing and in sliding communication with the shaft, a stem guide extending internally from the housing, said guide having bearing points in slidable contact with the stem near the head for holding the stem in alignment with the seat, said stem including a stop behind the head for receiving urging force, resilient means disposed between the stem guide and the stem for exerting forces simultaneously against the stem stop and housing for urging the stem head toward the valve seat and, by way of the actuating linkage, drawing and biasing the cam against the valve housing bearing area, said stem guide extending internally from the housing is formed to permit fluid passing through the valve to flow around the guide during its passage on out through the spigot, said valve housing includes an extending portion in intimate sliding contact with the cam for restricting the handle member's angular displacement to that of movement in a predetermined plane with respect to the housing, said valve seat element includes a threaded portion, and said tube coupling means for delivery of fluid to the valve, said valve housing includes threads and a stop for securing the valve seat in the housing to a predetermined depth when the valve seat element is screwed into the housing, said valve seat element includes at least two bearing surfaces for receiving torquing forces for installing and removing said element.

* * * * *